US005563904A

United States Patent [19]

Colpo et al.

[11] Patent Number: 5,563,904

[45] Date of Patent: Oct. 8, 1996

[54] PROCESS FOR MELTING AN ELECTROCONDUCTIVE MATERIAL IN A COLD CRUCIBLE INDUCTION MELTING FURNACE AND MELTING FURNACE FOR CARRYING OUT THE PROCESS

[75] Inventors: Pascal Colpo, Annecy; Jean Driole, Grenoble; Sylvian Witzke, Sauvigny Les Bois, all of France

[73] Assignee: Tecphy, Puteaux, France

[21] Appl. No.: 281,704

[22] Filed: Jul. 28, 1994

[30] Foreign Application Priority Data

Jul. 29, 1993 [FR] France ..... 93 09366

[51] Int. Cl.[6] ..... F27D 23/04; H05B 6/34

[52] U.S. Cl. ..... 373/146; 373/142; 373/156; 222/594; 266/237

[58] Field of Search ..... 373/142, 146, 373/151, 155, 156, 158; 222/594; 75/0.5 C, 70.18, 628; 266/237

[56] References Cited

U.S. PATENT DOCUMENTS

| | | | |
|---|---|---|---|
| 4,082,207 | 4/1978 | Garnier et al. | 222/594 |
| 4,863,509 | 9/1989 | Metz | 75/0.5 C |
| 5,074,532 | 12/1991 | Ducrocq et al. | 266/237 |
| 5,102,449 | 4/1992 | Ducrocq et al. | 75/70.18 |
| 5,280,496 | 1/1994 | Schlecht et al. | 373/158 |

FOREIGN PATENT DOCUMENTS

| | | |
|---|---|---|
| 0005676 | 11/1979 | European Pat. Off. . |
| 0021889 | 1/1981 | European Pat. Off. . |
| 0408453 | 1/1991 | European Pat. Off. . |
| 2316026 | 1/1977 | France . |
| 2397251 | 2/1979 | France . |
| 2396612 | 2/1979 | France . |
| 2646858 | 11/1990 | France . |
| 2649625 | 1/1991 | France . |
| 2665249 | 1/1992 | France . |
| 1583445 | 8/1970 | Germany . |

*Primary Examiner*—Tu Hoang
*Attorney, Agent, or Firm*—Cushman, Darby & Cushman

[57] ABSTRACT

A process for melting an electroconductive material (1) in a melting furnace (10) by induction in a cold crucible includes electromagnetically confining a mass of the electroconductive material (1) up to its melting temperature. Then, at least one vortex is created in the liquid material to inclusion particles contained in the liquid electroconductive material. The vortex or vortices are created by electromagnetic stirring. A part of the mass of the liquid electroconductive material (1) is poured in a pouring tube (15) disposed under the melting furnace (10), subjecting the jet of the pouring of the liquid electroconductive material (1) to a radial electromagnetic confinement, and ensuring a vertical coaxial alignment of the electromagnetic fields acting on the mass of liquid electroconductive material (1) and on the pouring jet of the mass. An induction melting furnace employing a cold crucible for carrying out this is also disclosed.

11 Claims, 3 Drawing Sheets

PROCESS FOR MELTING AN ELECTROCONDUCTIVE MATERIAL IN A COLD CRUCIBLE INDUCTION MELTING FURNACE AND MELTING FURNACE FOR CARRYING OUT THE PROCESS

BACKGROUND OF THE INVENTION

1. Field of the Invention

The present invention relates to a process for melting an electroconductive material in a cold crucible induction melting furnace and a melting furnace for carrying out the process.

2. Related Art

A process for melting an electroconductive material in a cold crucible induction melting furnace is known. The process comprises heating a mass of an electroconductive material to its melting temperature, decanting the solid inclusion particles contained in the liquid electroconductive material, and pouring a part of the mass of the liquid electroconductive material through a pouring conduit disposed under the melting furnace.

This process is usually employed for effecting a stabilized pouring of a molten metal with a variable pouring rate for producing metallic powders by atomization.

For this purpose, induction melting furnaces are known in which there is employed a crucible which receives an electroconductive material and is termed a cold crucible since it is permanently cooled.

In such furnaces, the partial or total melting of a mass of liquid electroconductive material is produced by an electromagnetic confinement so as to separate the mass of the liquid electroconductive material from the wall of the crucible.

To this end, the crucible comprises a plurality of metal sectors electrically insulated from one another and surrounded by means for the electromagnetic induction heating of the electroconductive material contained in the crucible.

The crucible is for example of cylindrical shape and comprises a substantially hemispherical or frustoconical bottom provided with a pouring orifice to which is fixed a tube for pouring the mass of liquid electroconductive material.

Cold metal crucible induction melting furnaces are preferred to refractory crucible furnaces which pollute the mass of liquid electroconductive material owing to contact between the material and the refractory walls of the crucible.

The pollution is due to the formation of inclusion particles of compounds which are for example oxidized compounds.

In particular applications, for example in the preparation of powders by the atomization of metals, this pollution incorporates into the powders many inclusions and it is in particular acknowledged that the presence of such inclusions in rotating parts of an aeronautic engine, for example based in nickel, may be the origin of defective behaviour in service of these parts subjected to fatigue stresses and in particular may result in premature fractures of the parts subjected to high stresses at high temperature.

In order to avoid these drawbacks, there have been proposed solutions - not fully satisfactory - based on the use of an electromagnetic nozzle forming the pouring orifice for the mass of liquid electroconductive material in which the latter has no contact with the walls of the nozzle.

In the field of the regulation of the rate of flow of a liquid metal through a pouring tube, patents FR-A-2 316 026, FR-A-2 396 612 and FR-A-2 397 251 also disclose electromagnetic devices operating at high frequency in which a copper screen must be used to obtain the desired confinement.

However, the adoption on an industrial scale of such a device, such as in an installation for the atomization of nickel-based superalloy powders, presents serious difficulties.

In order to avoid these difficulties, there is known from patent FR-A-2 649 625 an electromagnetic nozzle comprising a coiled inductor associated with a device for concentrating the magnetic field disposed between the coiled inductor and the walls of the pouring orifice.

Such a nozzle has the drawback of being conditioned, in its operation, by the choice of specific parameters of size, and parameters of definition of the magnetic field applied, such as for example the frequency and the intensity of said magnetic field.

Moreover, this nozzle has a large size and low efficiency.

Further, there is also known from patent FR-A-2 665 249 a cold crucible furnace associated with a magnetic yoke which makes it possible to bring the field lines closer together at the level of the upper surface of the molten charge contained in the crucible.

This bringing together of the field lines results in a centripetal driving of the molten matter at the level of the surface of the molten material, which results in a stirring of the molten charge in a direction opposed to the natural stirring direction produced in the absence of such a yoke.

This centripetal motion at the level of the upper surface of the molten charge enables the substances which are not yet perfectly melted and float on the surface of the charge, to be brought to the center and thereafter swallowed up in this charge and consequently permits a stirring of the mass of molten materials without taking into account inclusions present in the molten mass.

There is also known from patent FR-A-2 646 858 a process for decanting the inclusions of a molten metallic mass comprising employing a displacement of the inclusion particles toward the surface, in the thickness of the electromagnetic skin, and then a trapping of the particles by the coldest particles of the crucible.

In this process, two phenomena are employed, namely an electromagnetic stirring which brings the inclusions within the mass of molten metal toward the region of the electromagnetic skin and a capturing of the inclusions in the region of the skin, these inclusions being moved toward the wall of the crucible and the surface of the molten metal mass under the effect of the magnetic pressure forces.

SUMMARY OF THE INVENTION

An object of the invention is to provide a process for melting an electroconductive material in a cold crucible induction melting furnace which ensures a dynamic purification in volume of the mass of liquid electroconductive material before and during the pouring, by decantation of the inclusions.

The invention therefore provides a process for melting an electroconductive material in a cold crucible induction melting furnace. The process includes:

- decanting the inclusion particles contained in the liquid electroconductive material,
- pouring a part of the mass of liquid electroconductive material through a pouring tube disposed under the melting furnace, subjecting the pouring jet of the liquid electroconductive material to a radial electromagnetic confinement, ensuring a vertical coaxial alignment of the electromagnetic field acting on the mass of liquid electroconductive material and on the pouring jet of the mass, and creating in the mass of liquid electroconductive material by an electromagnetic stirring, at least one vortex in which the inclusion particles are driven in a whirling motion and decanted as they reach the surface of the mass of liquid electroconductive material.

According to another feature of the invention, at least two superimposed vortices are created in the mass of molten electroconductive material subjected to the electromagnetic stirring.

The invention also provides a furnace for the cold crucible induction melting of an electroconductive material for carrying out the aforementioned process. The melting furnace includes a crucible for containing the electroconductive material and composed of a plurality of metal sectors electrically insulated from each other, means for cooling the metal sectors, means for heating by electromagnetic induction the electroconductive material and disposed around the crucible, a tube for pouring the liquid electroconductive material disposed vertically under the crucible, and electromagnetic means for confining the jet of liquid electroconductive material in the pouring tube, the electromagnetic means being disposed around the pouring tube and supplied with power by a generator, wherein the that said furnace comprises means for centering the electromagnetic means for confining the jet of liquid of electroconductive material relative to the vertical axis of the pouring tube and of the crucible, and means for centering and positioning the sectors of the crucible relative to the means for heating by electromagnet induction the electroconductive material and relative to the electromagnetic means for confining the jet of liquid electroconductive material.

According to other features of the melting furnace according to the invention are set forth below.

The means for centering the electromagnetic means for confining the jet comprise a case composed of an electrically and thermally insulating material and enclosing said electromagnetic means for confining the jet.

The means for centering and positioning the sectors of the crucible includes a shell composed of an electrically and thermally insulating material disposed around the sectors and enclosing the means for heating by electromagnetic induction the electroconductive material and the means for cooling the sectors.

The means for confining the jet of liquid electroconductive material includes an extra flat electromagnetic coil, the electromagnetic coil comprises ten turns in the form of copper plates arranged on a height of 30 mm, for a jet of electroconductive material of about 12 mm in diameter.

The pouring tube is formed by a metal cylinder in sectors having a double wall and cooled by circulation of a fluid, the generator supplying power to the electromagnetic means delivers a signal at such frequency that the ratio between the radius of the section of the jet of electroconductive material and the depth of penetration of the electromagnetic field is greater than 1.7.

BRIEF DESCRIPTION OF THE DRAWINGS

Further features and advantages of the invention will be apparent from the following description given solely by way of example with reference to the accompanying drawings, in which.

DETAILED DESCRIPTION OF THE PREFERRED EMBODIMENTS

Figure 1:
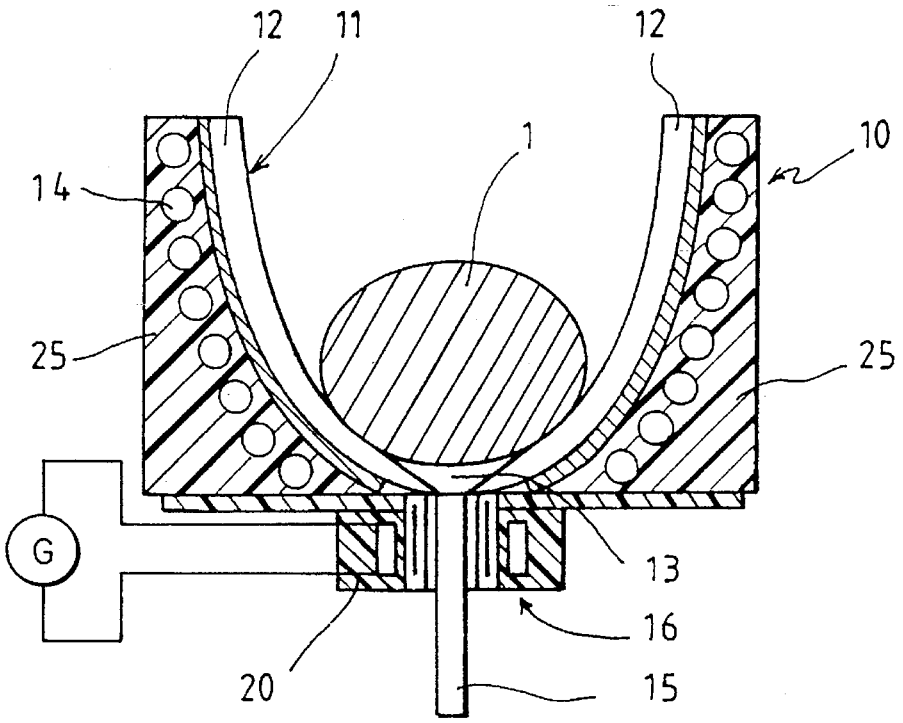
FIG. 1 is a diagrammatic sectional view of a cold crucible induction melting furnace according to the invention.

Shown diagrammatically in FIG. 1 is a induction melting furnace 10 employing a cold crucible for in particular the purification of a mass 1 of an electroconductive material before its atomization in the production of powders.

The melting furnace 10 comprises a crucible 11 for containing the electroconductive material 1 and composed of a plurality of metal sectors 12 electrically insulated from one another and each provided with cooling means employing a circulation of water (not shown in FIG. 1).

The number of metal sectors 12 is for example nine.

The crucible 11 is for example of cylindrical shape and extended by a substantially hemispherical or frustoconical bottom provided with a pouring orifice 13 for the mass of liquid electroconductive material 1.

The melting furnace 10 further comprises means 14 for the electromagnetic induction heating of the electroconductive material 1 disposed around the crucible 10.

The electromagnetic induction heating means 14 comprises for example eight coil turns or helices.

The melting furnace 10 further comprises a pouring tube 15 for the liquid electroconductive material 1 disposed vertically under the crucible 11 and on the axis of the pouring orifice 13, and means 16 for confining the jet of the liquid electroconductive material 1 in said pouring tube 15.

The electromagnetic means 16 for confining the jet of the liquid electroconductive material are disposed around the pouring tube 15 and supplied with power by a generator 6.

Figure 2:
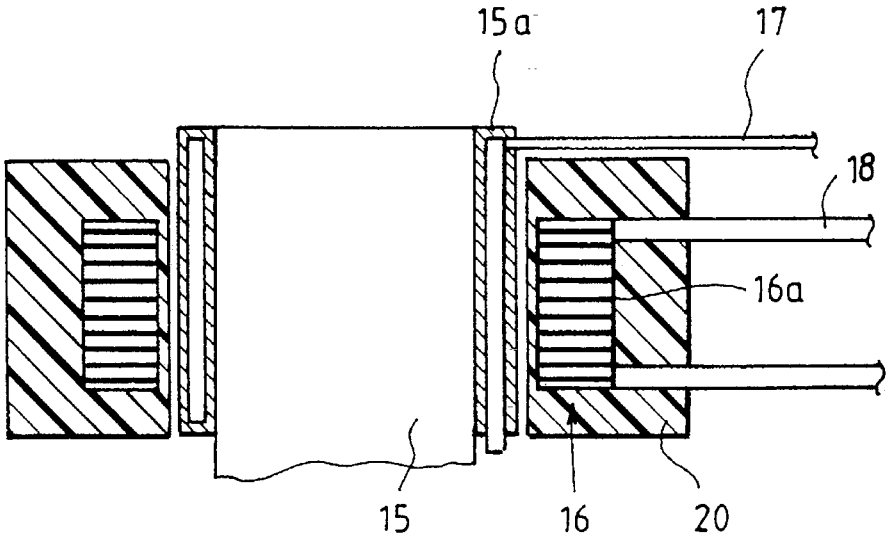
FIG. 2 is a diagrammatic sectional view to a larger scale of the pouring tube disposed under the melting furnace.

As shown in FIG. 2, the pouring tube 15 comprises eight sectors of a cylinder **15*a* cooled by a circuit 17** in which circulates a fluid, for example water.

The means 16 for confining the jet of the liquid electroconductive material 1 in the pouring tube 15 comprise an extra flat electromagnetic coil **16*b*, for example a BITTER coil, having for example ten turns or helices 16*a*** in the form of copper plates arranged on a height of 30 mm for a jet of electroconductive material of about 12 mm in diameter.

Each of the copper plates is provided with thirty-six openings 2.5 mm in diameter connected to a circuit 18 providing a transverse circulation of water for cooling the electromagnetic coil 16.

Further, the melting furnace 10 comprises means 20 for centering the electromagnetic coil 16 confining the jet of liquid electroconductive material relative to the vertical axis of the pouring tube 15 and of the crucible 11, and means 25 for centering and positioning the sectors 12 of the crucible 11 relative to the means 14 for heating by electromagnetic induction the electroconductive material 1 and relative to the electromagnetic coil 16.

The means for centering the electromagnetic coil 16 comprise a case 20 of insulating material, for example PERMAGLAS, enclosing the turns 16*a* of the electromagnetic coil 16.

The means for centering and positioning the sectors 12 of the crucible 11 comprises a shell 25 of insulating material, for example PERMAGLAS, disposed around the sector 12 and enclosing the means 14 for heating by electromagnetic induction the electroconductive material 1 and the means for cooling the sectors 12.

This covering permits maintaining in position the coil turns of the means 14 for heating by induction the electroconductive material 1 and the crucible 11, which avoids hydrodynamic disturbances in the mass of liquid electroconductive material.

In the case of the preparation of a powder by atomization of the electroconductive material, the induction furnace 10 comprising the crucible 11 and the pouring tube 15 may be placed in an enclosure having a controlled atmosphere and the pouring jet of the electroconductive material is made to burst so as to form the powder.

The perfect vertical cylindrical geometry of the pouring jet of the electroconductive material is an important, and even essential, feature of the good quality of the powders obtained by atomization.

In an example of an application, the mass of electroconductive material 1 constituted by a superalloy steel 5 cm in radius is placed in the crucible 11 and the power transmitted by the electromagnetic induction heating means 14 is on the order of 50 KW for a power of 1000 A at a frequency of 20 KHz.

The process for melting the electroconductive material 1 in the melting furnace 10 includes the following steps. First, the mass of electroconductive material 1 is confined in the melting furnace 10 up to its melting temperature. Next, the solid or liquid inclusion particles contained in the liquid electroconductive material 1 are decanted. Third, a part of the mass of liquid electroconductive material is pouring through the pouring tube 15. Thus subjecting the pouring jet of the liquid electroconductive material 1 to a radial electromagnetic confinement.

Fourth, a vertical coaxial alignment of the electromagnetic fields acting on the mass of liquid electroconductive material 1 and on the pouring jet of the mass is ensued. Finally, at least one vortex 30 (FIG. 3) is created in the mass of liquid electroconductive material 1 by electromagnetic stirring. In the vortex the solid inclusion particles are driven in a whirling motion and decanted as they reach the surface of the mass of liquid electroconductive material 1.

Preferably, at least two superimposed vortices 30 are created in the mass of liquid electroconductive material 1 subjected to the electromagnetic stirring.

Indeed, the applicant has found that the non-conductive particles contained in the mass of electroconductive material 1 to be treated, were subjected in the electromagnetic whirling medium to a series of forces such as the driving force, the virtual mass, the Archimedes thrust, the hydrodynamic pressure, and the Lorentz force, which made it possible to deduce the behaviour of the inclusions in a particular electromagnetic stirring.

In taking into account these different parameters, the applicant determined a configuration which was the most favourable to the separation of the non-conductive inclusion particles contained in the mass of the molten and confined electroconductive material, and to their decantation on the surface of this mass.

The most favourable configuration for this decantation is achieved by the shape of the free surface of the mass of liquid electroconductive material, the dimension of this mass, the thickness of the electromagnetic skin, the morphology of the electromagnetic stirring and the geometry of the pouring jet.

This is why the process according to the invention comprises, in the course of the electromagnetic stirring, creating in the mass of liquid electroconductive material 1 at least one vortex 30 in which the solid or liquid inclusion particles are driven in a whirling motion in a spiral and decanted when they reach the surface of this mass of liquid electroconductive material 1.

This is achieved by ensuring in particular a coaxial alignment between the axis of the crucible 11 containing the mass of liquid electroconductive material 1 and the longitudinal axis of the pouring tube 15.

This coaxial alignment requires that the electromagnetic coil 16 of the means for confining the jet generate an electromagnetic field which is in cylindrical symmetry with the vertical axis of the melting furnace 10.

Whereas up to the present time the geometry of the electromagnetic jet-confining coil had seemed to be negligible, the applicant has found that this geometry has a primordial function.

Indeed, a conventional spiral-shaped coil with a conductor having a circular tubular section cannot be suitable for the confinement of the pouring jet, since each of the turns forms a power path which extends in an inclined plane relative to the vertical axis directly depending on the pitch of the helix of the electromagnetic coil.

Consequently, a conventional electromagnetic coil generates a magnetic field which creates instabilities in the pouring of the jet.

In order to avoid this disturbance, the means for confining the pouring jet of the mass of electroconductive material according to the invention comprise an extra flat electromagnetic coil 16 of the previously-described type.

In order to ensure the cylindrical symmetry of the pouring jet, the electromagnetic field generated by the electromagnetic coil 16 is so determined that the rise in magnetic pressure is maximum for a given power of the generator supplied to the electromagnetic coil 16.

Figure 3:
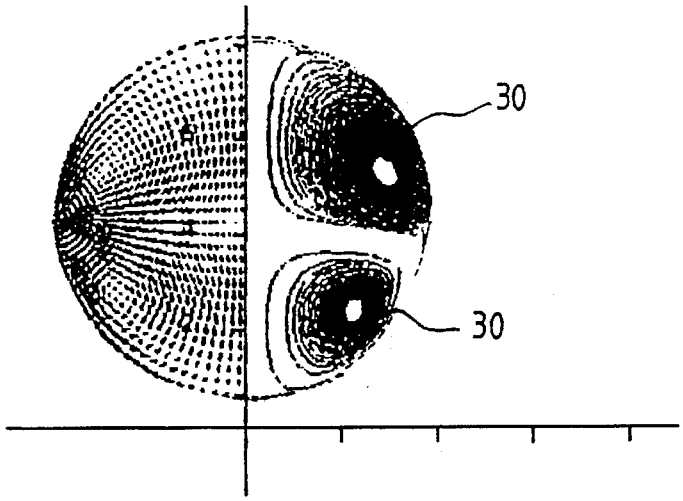
FIG. 3 is a diagram of the mass of electroconductive material confined electromagnetically.

Shown in FIG. 3 is a diagram of the motion of the mass of liquid electroconductive material 1 which is materialized by the two superimposed vortices 30 the speed of displacement of which is about 0.2 m/s.

Figure 4:
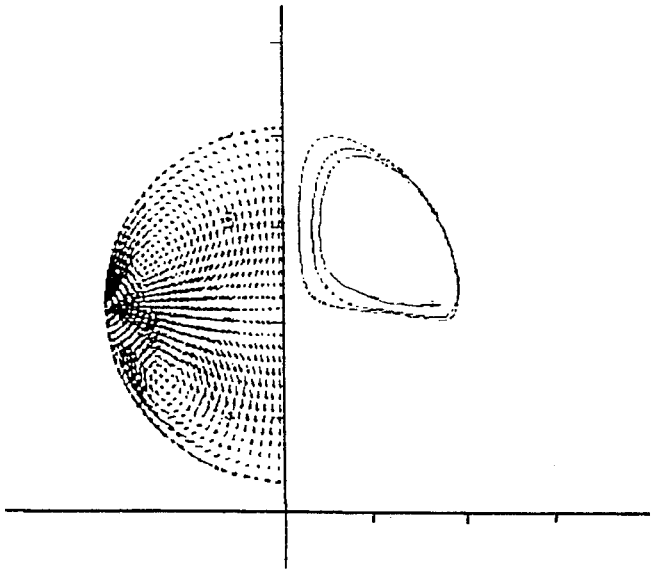
FIGS. 4 and 5 are two diagrams materializing the displacement of the inclusion particles in the mass of electroconductive material.
Figure 5:
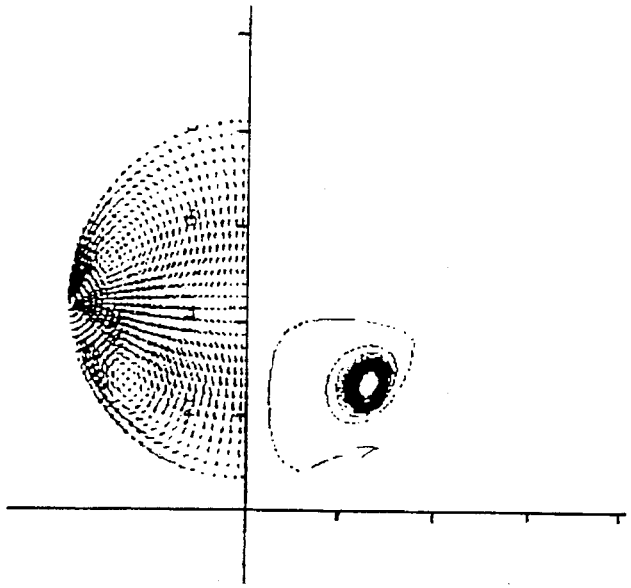

FIGS. 4 and 5 show two diagrams materializing the displacement of the non-conductive inclusion particles respectively in the upper vortex and in the lower vortex.

It is known that the solid inclusion particles are decanted as soon as they reach the surface of the mass of liquid electroconductive material 1, without taking into account the mechanism of the capturing of these particles in the region of the free surfaces or of a cold wall by interfacial phenomena such as the magnetic pressure.

The measurement of the decantation time permits mastering the minimum melting time of the mass of electroconductive material and of the stirring of this mass which ensures the purification by decantation of the inclusion particles of a given size.

The inclusion particles-separating time is maximum for the particles initially located close to the center of the vortex or vortices 30 and the decantation time is very great for the inclusion particles of small sizes.

Further, the applicant has found that the efficiency of the electromagnetic confinement of the pouring jet of the mass of electroconductive material 1 increases with increase in the rise in magnetic pressure between the axis and the surface of the pouring jet.

Indeed, the rise in pressure is a function of the electromagnetic force applied and of the depth of penetration of the magnetic field in the pouring jet.

For a constant generator power, there is an optimum frequency which permits obtaining the highest pressure rise.

Figure 6:
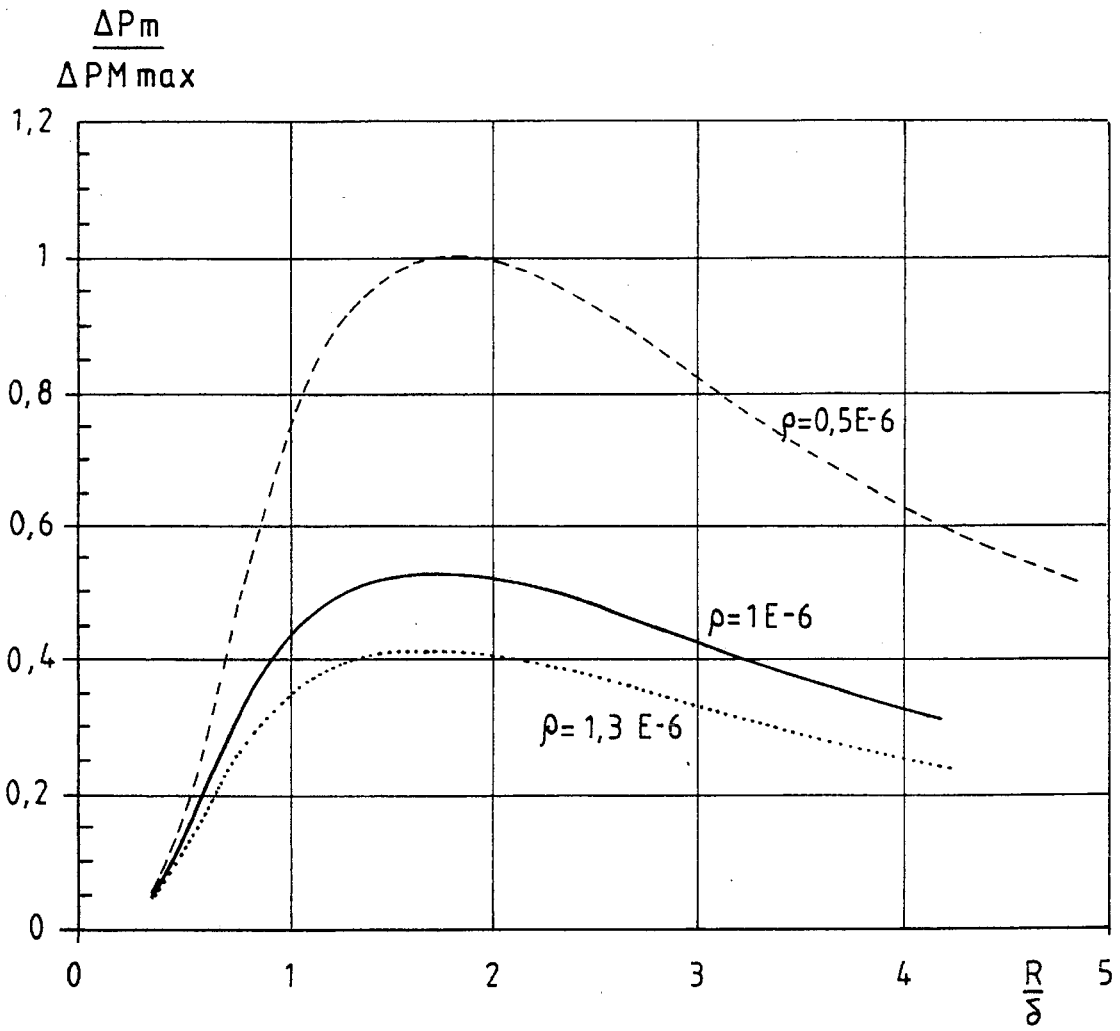
FIG. 6 is a curve representing a variation in the rise in magnetic pressure between the axis of the pouring jet and its surface as a function of the frequency of the signal delivered by the generator supplying power to the electromagnetic means confining the pouring jet.

FIG. 6 shows three curves representing the variation of the value of the pressure rise $\Delta Pm$ as a function of the ratio of the radius R of the pouring jet to the depth of penetration $\Delta$ of the magnetic field, for different electric resistivities $\rho$ of the electroconductive material.

This Figure shows that the optimum of the pressure rise $\Delta Pm$ is reached for a ratio of the radius R of the pouring jet to the depth of penetration $\delta$ of the magnetic field, equal to about 1.7, which corresponds, for a radius of the pouring jet of 7 mm of an alloy having a resistivity of 130 $10^{-8}\Omega$cm at a frequency of about 20 KHz.

The process according to the invention permits, owing to the electromagnetic confinement of the pouring jet associated with the coaxiality of the magnetic fields of the pouring jet-confinement means, the means for induction heating the mass of electroconductive material, the crucible and the mass of electroconductive material, controlling the electromagnetic stirring of this liquid mass, while ensuring the continuous separation of the solid inclusion impurities contained in the electroconductive material and also obtaining an improved quality of the products.

What is claimed is:

1. A process for melting mass of electroconductive material in an induction melting furnace employing a cold crucible, said process comprising:

electromagnetically confining in said melting furnace a mass of said electroconductive material up to its melting temperature, decanting inclusion particles contained in liquid electroconductive material, pouring a part of the mass of said liquid electroconductive material as a pouring jet through a pouring tube disposed under said melting furnace, subjecting said jet of said liquid electroconductive material to a radial electromagnetic confinement, ensuring a vertical coaxial alignment of electromagnetic fields producing said electromagnetic confinement of said mass of liquid electroconductive material and said pouring jet, and creating, by an electromagnetic stirring in said mass of liquid electroconductive material at least one vortex in which inclusion particles are driven in a whirling motion and decanted upon reaching surface of said mass of liquid electroconductive material.

2. A process according to claim 1, comprising creating in said mass of liquid electroconductive material subjected to said electromagnetic stirring at least two superimposed vortices.

3. A furnace for melting an electroconductive material by induction in a cold crucible, said furnace comprising:

a crucible having a vertical axis for containing said electroconductive material and including a plurality of metal sectors electrically insulated from each other, means for cooling said metal sectors, means for heating said electroconductive material by electromagnetic induction disposed around said crucible, a pouring tube for a jet of liquid electroconductive material disposed under said crucible with a vertical axis, and electromagnetic means for confining said jet of liquid electroconductive material in said pouring tube, said electromagnetic confining means being disposed around said pouring tube, and a generator connected to said electromagnetic confining means for supplying power thereto, means for centering said electromagnetic confining means relative to said vertical axis of said pouring tube and said vertical axis of said crucible, and means for centering and positioning said sectors of said crucible relative to said means for heating by electromagnetic induction and relative to said electromagnetic confining means.

4. A furnace according to claim 3, wherein said means for centering said electromagnetic confining means comprises a case of an electrically and thermally insulating material surrounding said electromagnetic confining means.

5. A furnace according to claim 3, wherein said centering and positioning means for said sectors of said crucible comprises a shell of an electrically and thermally insulating material disposed around said sectors and surrounding said means for heating by electromagnetic induction and said means for cooling said sectors.

6. A furnace according to claim 3, wherein said means for confining said jet of said liquid electroconductive material comprises an extra flat electromagnetic coil.

7. A furnace according to claim 4, wherein said means for confining said jet of said liquid electroconductive material comprises an extra flat electromagnetic coil.

8. A furnace according to claim 6, wherein said electromagnetic coil comprises ten turns in the form of copper plates constructed and arranged over a height of 30 mm for said jet of said electroconductive material, which is substantially 12 mm in diameter.

9. A furnace according to claim 7, wherein said electromagnetic coil comprises ten turns in the form of copper plates constructed and arranged over a height of 30 mm for said jet of said electroconductive material, which is substantially 12 mm in diameter.

10. A furnace according to claim 3, wherein said pouring tube comprises a metal cylinder having a double wall for the cooling thereof by circulation of a fluid.

11. A furnace according to claim 3, wherein said generator is disposed so as to deliver a signal at such a frequency that a ratio between a radius of a section of said jet and a depth of penetration of an electromagnetic field produced by said electromagnetic confining means is greater than 1.7.

* * * * *